United States Patent [19]

Bonfiglioli et al.

[11] Patent Number: 4,756,288

[45] Date of Patent: Jul. 12, 1988

[54] FUEL METERING AND PRESSURE REGULATION DEVICE FOR A MANIFOLD OF AN INTERNAL COMBUSTION ENGINE

[75] Inventors: Silverio Bonfiglioli, Zola Predosa; Gianni Fargnoli, Anzola Emilia, both of Italy

[73] Assignee: Weber S.p.A., Italy

[21] Appl. No.: 912,496

[22] Filed: Sep. 29, 1986

[30] Foreign Application Priority Data

Oct. 11, 1985 [IT] Italy ..... 67859 A/85

[51] Int. Cl.[4] ..... F02M 37/04

[52] U.S. Cl. ..... 123/460; 123/463

[58] Field of Search ..... 123/460, 463, 470, 473

[56] References Cited

U.S. PATENT DOCUMENTS 4,357,921 11/1982 Ciaccio ..... 123/463

4,458,650 7/1984 Kessler ..... 123/463

FOREIGN PATENT DOCUMENTS 10157 1/1983 Japan ..... 123/460

*Primary Examiner*—Douglas Hart

*Attorney, Agent, or Firm*—Andrus, Sceales, Starke & Sawall

[57] ABSTRACT

The device comprises an electromagnetically operated fuel atomisation and metering valve housed in a seat in a body of the device, and a pressure regulator for regulating the pressure of the fuel in a region upstream of the valve; this regulator includes a deformable diaphragm connected to a shutter member operable to control a fuel passage opening between the said upstream region and a discharge; the body of the device includes a support plate for the deformable diaphragm, which is made integrally with the body itself, and the diaphragm is fixed to this latter by means of a bell-shape element defining a chamber closed by the diaphragm and in hydraulic communication with a region downstream of the valve.

5 Claims, 2 Drawing Sheets

FUEL METERING AND PRESSURE REGULATION DEVICE FOR A MANIFOLD OF AN INTERNAL COMBUSTION ENGINE

BACKGROUND OF THE INVENTION

The present invention relates to a device for supplying a mixture of air and fuel to a manifold of an internal combustion engine of the type having a fuel atomisation and metering valve housed in a seat in a body of the device, which valve is electromagnetically operated and able to deliver a predetermined quantity of fuel to a region downstream of the valve.

Devices of this type normally include a pressure regulator arranged to regulate the pressure of the fuel in a region downstream of the valve. This regulator normally comprises a deformable diaphragm connected to a shutter member operable to control a fuel passage opening between the said upstream region and a discharge; the pressure regulator further includes a casing within which are defined two chambers for the fuel, which chambers are separated by the deformable diaphragm which is therefore in equilibrium between the pressures of the fuel which is found in the two chambers; one of these chambers is in hydraulic communication with the said region upstream of the valve while the other is in hydraulic communication with the region downstream of the valve.

Therefore, when the pressure upstream of the valve exceeds a predetermined value it causes a deformation of the diaphragm in a sense such as to displace the shutter member to increase the flow cross section of the said passage opening for discharging a certain quantity of fuel under pressure towards the discharge, thereby in this way reducing the pressure of the fuel in the said zone upstream of the valve.

Devices of the type indicated have various disadvantages.

First of all, they are constructionally very complicated because of the ducts which are necessary to connect the pressure regulator with the body of the device; in fact, the pressure regulator constitutes a completely separate unit from the body of the device and the said two chambers with which it is provided must be connected by means of suitable ducts to the regions upstream and downstream of the valve which are defined within the body of the device itself. These ducts are normally formed by means of small, suitably curved, tubes and by means of holes formed in the body of the device and in the casing of the pressure regulator. Consequently, a certain complexity in the constructional arrangement and a low reliability from the hydraulic point of view, is encountered both in the connection region between the small tubes and the first mentioned holes, and in the regions in which the said holes are closed by means of plugs of suitable type; in fact, the duct sections which are formed in the body of the device and in the casing of the pressure regulator usually comprise several holes in communication with one another, each of which is made as a through hole: only subsequently one end of these holes is closed by a suitable plug. It is evident that in the connection regions between the small tubes and the holes, and in the region in which these plugs are disposed, fuel pressure losses can easily be produced. Moreover, the ducts which are formed in the first indicated way, which are usually of a rather great length and have numerous and sharp variations in direction, also present a high resistance to the movement of the fuel; the pressure losses can be considerable and consequently the sensitivity of the pressure regulator and the rapidity of operation thereof is consequently reduced. Further, in known devices of the first indicated type, the first mentioned fuel ducts between the body of the device and the pressure regulator normally constitute an obstacle to the regular flow of air between the air intake opening of the device itself and the outlet for delivery of mixture to the manifold. In fact, the two said regions upstream and downstream of the attomisation and metering valve are normally located in the immediate proximity of the valve itself and this, in turn, is disposed within the air duct. Consequently, to put these regions in communication with the pressure regulator the first mentioned fuel ducts must traverse the said air duct thereby complicating the form of this and modifying the regular flow of air.

SUMMARY OF THE INVENTION

The object of the present invention is that of providing a supply device for air and fuel mixture to a manifold of an internal combustion engine of the type first indicated, which will be free from the disadvantages which have been described and therefore which will be constructionally very simple and of small size, and of great reliability, which will allow the first mentioned regions to be put in hydraulic communication with the pressure regulator with low pressure losses, and allow a flow of air and of air and fuel mixture along the associated ducts between the air induction opening and the mixture delivery opening to be obtained as a regular flow without significant pressure losses.

These objects are achieved with a device for supplying a mixture of air and fuel to a manifold of an internal combustion engine, comprising an electromagnetically operated fuel atomisation and metering valve housed in a seat of the body of the device and operable to deliver predetermined quantities of fuel to a region downstream of the valve, and a pressure regulator operable to regulate the pressure of the said fuel in a region downstream of the valve, the said pressure regulator comprising a deformable diaphragm connected to a shutter member operable to control a fuel passage opening between the said upstream region and a discharge, the said deformable diaphragm being in equilibrium between the pressure of the fuel and the force exerted by a spring, characterised in that the said body includes a support plate for the said deformable diaphragm of the pressure regulator, which is integrally made with the said body, the said diaphragm being fixed to the body itself by means of a bell-shaped element defining a first chamber closed by the said diaphragm and in hydraulic communication with the said region downstream of the valve.

BRIEF DESCRIPTION OF THE DRAWINGS

For a better understanding of the invention a more detailed description of it will now be given by way of example with reference to the attached drawings, in which.

DETAILED DESCRIPTION OF THE INVENTION

Figure 1:
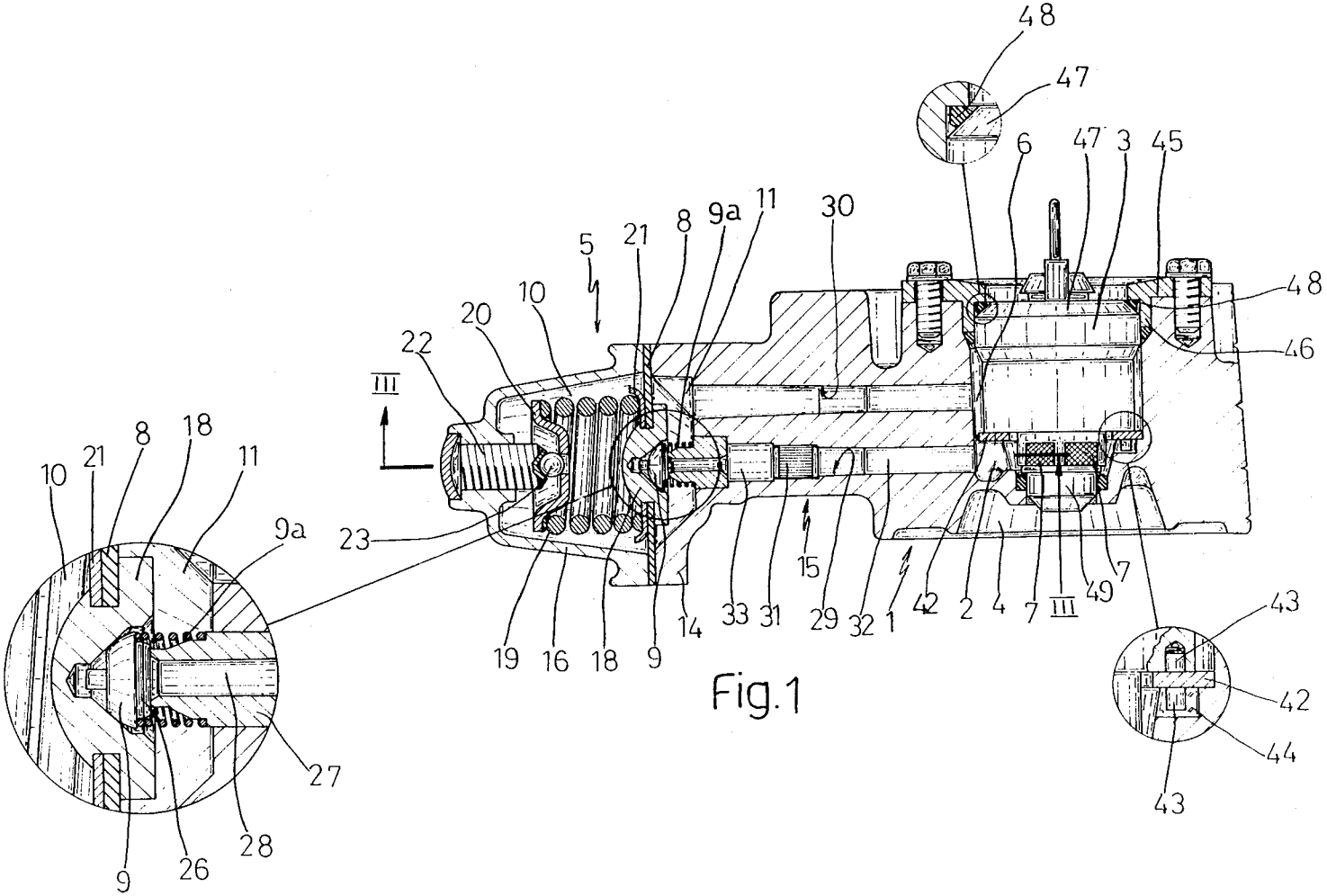
FIG. 1 is a vertical section showing a part of the device of the invention.

The device of the invention comprises a body 1 in which there is formed a seat 2 for a fuel atomisation and metering valve 3, of the type which is able to deliver predetermined quantities of atomised fuel to a region 4 downstream of the valve itself, which is located along the duct for supply of air and mixture of air and atomised fuel (not shown) which lies between an air inlet and an outlet for delivery of mixture to the manifold of a heat engine.

The device of the invention further includes a pressure regulator 5 which is operable to regulate the pressure of the fuel in a region upstream of the valve, which has been indicated with the reference numeral 6; the fuel is delivered to a region downstream of the valve 3 which is defined within the seat 2 of the valve 3 in immediate proximity to the fuel induction openings 7 with which the valve is provided.

The pressure regulator, which is known per se, comprises a deformable diaphragm 8 connected to a shutter member 9 (biased by a spring 9*a*) which is operable to control, in a manner which will be described, a fuel passage opening between the said upstream region 6 of the valve 3 and a discharge. This diaphragm separates a pair of chambers 10 and 11, the first of which is in hydraulic communcation with the said region 4 downstream of the valve 3 and the second of which is in hydraulic communication with the region 6 upstream of the valve itself.

According to the invention, the body 1 of the device includes a support plate 14 against which the deformable diaphragm 8 can lie, which plate is made integrally with the body 1; conveniently, this plate is formed on a projecting part 15 of the body 1; this part projects in a direction substantially orthogonal to the axis of the body 1, which coincides with the axis of the atomisation and metering valve 3.

Figure 2:
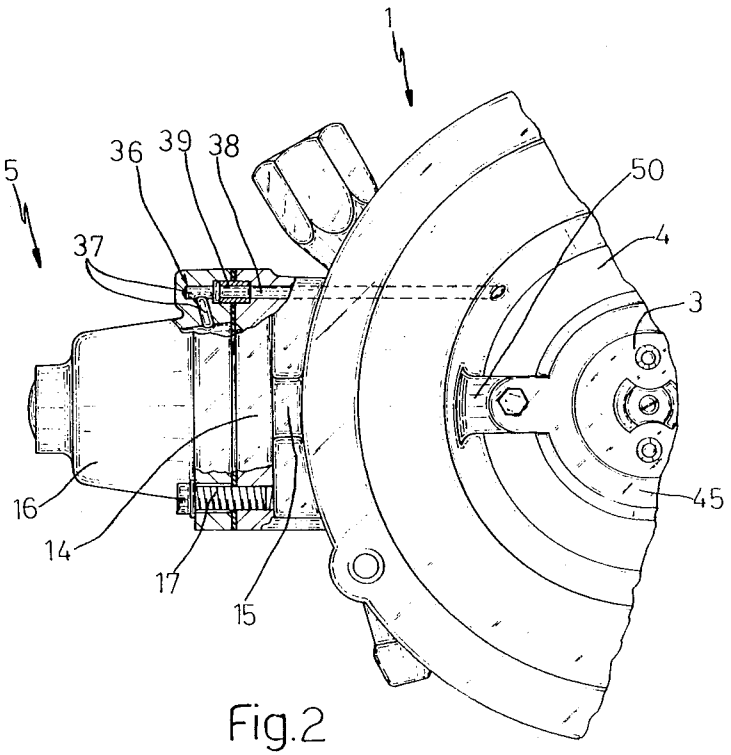
FIG. 2 is a plan view from above of the part of the device of FIG. 1.

On the support plate 14 there is fixed a bell-shape element 16 able to define the chamber 10 and to fix the diaphragm itself to the plate: this connection can conveniently be made by means of screws 17 (FIG. 2).

Conveniently, as can be seen clearly in FIG. 1, the pressure regulator 5 further includes a support disc 18 for the shutter member 9 fixed to the deformable diaphragm 8, a coil spring 19 interposed between a pair of rings 20 and 21 the first of which can be displaced axially by acting on an adjustment screw 22 which engages against the ring itself with the interposition of a ball 23, and the second of which directly contacts the diaphragm 8. The shutter member 9 controls a passage opening 26, which is defined between the member itself and a bush 27 provided with an axial hole 28 in communication with the discharge in a manner which will be described.

The body 1 includes a first rectilinear hole 29 substantially coaxial with the shutter member 9 which puts the chamber 11 in hydraulic communication with the region 6 upstream of the valve 3, and a second rectilinear hole 30 which puts this latter region in communication with the chamber 11; the first hole 29 is closed by a plug 31 which separates the hole itself into two hole sections indicated 32 and 33, the first of which is in communication with the fuel supply duct by means of a fourth hole 34. (FIG. 3), and the second of which is in communication with the discharge by means of a fifth hole 35. Therefore the shutter member 9 controls the flow fuel from the chamber 11 towards the fifth hole 35 and then towards the discharge.

Figure 3:
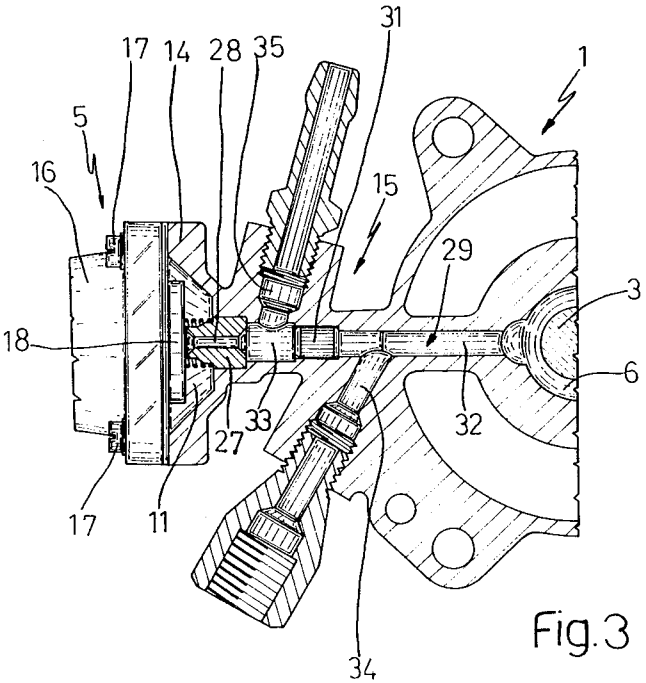
FIG. 3 is a section of the part of the device of FIG. 1 taken on the line III—III of FIG. 1.

The axes of the holes 29,34 and 35 are disposed in substantially the same horizontal plane as can be seen clearly in FIG. 3, and the axes of the holes 29 and 30 are disposed in the same vertical plane.

The chamber 10 is in communcation with the region 4 downstream of the valve 3 by means of a duct generally indicated 36 (FIG. 2) comprising several hole sections, two of which 37 are formed in the bell-shape element 16 and a third, 38, of which is formed in the projecting part 15 of the body 1; conveniently, the sections 37 and 38 are connected by means of a connector element 39.

The atomisation and metering valve 3 is supported in the associated seat by means of a support ring 42 of deformable material (FIG. 1), from the opposite faces of which project two studs 43, one of which can be inserted in a corresponding hole of the valve 3 and the other of which can be inserted into a corresponding cavity 44 of the body 1 for the purpose of positioning the valve in its correct angular position with respect to the body. The fixing of the valve is achieved by means of a collar 45 provided with an annular projection 46 on the inner surface of which the valve 3 is centred; this latter is provided with a substantially conical surface 47 and between this latter and the collar 45 there is interposed a ring 48 of deformable material having a substantially trapezoidal section.

The deformability of the material of this ring is significantly greater than that of the support ring 42; conveniently the deformability of this first ring is equal to ten times that of the second ring.

The operation of the device described is as follows.

Into the flow of air inducted through the air duct are injected predetermined quantities of atomised fuel delivered by the atomisation and metering valve 3; this fuel is sprayed from the injection nozzle 49 of this valve into the region 4 downstream of the valve itself in such a way as to mix with the air which is moving along the said duct to form an air and fuel mixture which is conveyed towards the mixture delivery opening of the device (not shown).

The fuel which is supplied to the valve 3 coming from the hole 34 (FIG. 3) through the first section 32 of the hole 29, is conveyed into the region 6 upstream of the valve 3 itself and, through the perforations 7 of this latter is supplied to the valve. The fuel from the region 6 arrives at the chamber 11 through the hole 30 to act on the surface of the deformable diaphragm 8; therefore the pressure of the fuel in the region 6 upstream of the valve is caused to act on the diaphragm 8 through the said hole and the chamber 11; similarly, the pressure of the air within the region 4 downstream of the valve 3 is caused to act on the other surface of the deformable diaphragm 8 through the duct 36 which includes the sections 37 and 38. In each instance the deformable diaphragm 8 is substantially in equilibrium under the action of the resultants of the said pressures which act on its two opposite faces and the force generated by the spring 19. The pressure regulator is calibrated in such a why that when the pressure difference between the two chambers 11 and 10 exceeds a predetermined value the diaphragm 8 is displaced towards the left of FIG. 1 to separate the shutter member 9 from the bush 27 and therefore increase the fuel passage opening 26 which can therefore allow fuel to flow from the chamber 11 through the hole 28 of the bush towards the second section 33 of the hole 29, and then towards the hole 35 and the discharge.

In this way the correct value of the pressure difference which must be maintained between the region 6 upstream of the valve 3 and the region 4 downstream of the valve can be regained.

It is therefore evident that the device of the invention obtains a close integration between the pressure regulator 5 and the body 1 of the device in such a way as to obtain a very compact assembly of small dimensions. In fact, several of the fundamental parts of the pressure regulator 5, such as the plate 14 and the ducts which are necessary to put the pressure regulator in communication with the region 6 upstream and downstream of the atomisation and metering valve 3, are formed directly within the parts of the body 1 of the device. Moreover, since the said ducts, which are formed substantially by the holes 29 and 30, are of short length and do not have any sharp variations in direction, the fuel can move within them with negligible pressure losses therefore allowing the presure of the fuel to be transmitted extremely quickly and precisely from the region 6 upstream of the valve 3 into the chamber 11 of the pressure regulator.

Moreover, the said holes are formed in a simple manner and with considerable precision and do not have ends closed by plugs which could render the device less reliable because of the losses which could take place in the regions in which the plugs are disposed.

Finally, the flow of air which moves through the air ducts towards the region 4 downstream of the valve 3 is perturbed in an entirely negligible manner by the presence of the holes 29 and 30, since the axes of these are disposed in the same vertical plane and therefore these holes can be formed simply in a bridge 50 (FIG. 2) of very reduced dimensions.

The described assembly of the valve 3 formed by means of the rings 42 and 48 ensures a correct centering of the valve with respect to the body 1 because of the presence of the annular projection 46 of the collar 45 within which the valve itself is centred, and a perfect angular positioning of this latter with respect to the body itself because of the coupling of the studs 43 and the corresponding holes of the valve and the body. Moreover, the considerable deformability of the ring 48 causes a resilient axial pre-load on the valve itself upon assembly, which effectively opposes vibrations which occur during the operation of the valve.

It is apparent that the form and arrangements of the various parts of the device of the invention can be modified and varied without by this departing from the scope of the invention itself.

What is claimed:

1. In a device for supplying a mixture of air and fuel to the manifold of an internal combustion engine:

(a) a support body (1), (b) an electromagnetically operated fuel atomisation and metering valve (3) housed in said body and defining a first axis; said body forming a region (4) downstream of said valve, and said valve forming means for delivering predetermined quantities of fuel to said downstream region, (c) a projection (15) integrally formed with said body and extending laterally from said valve, (d) a fuel pressure regulator (5) mounted to an end of said projection and defining a second axis generally normal to said first axis, (e) said pressure regulator being responsive to pressure in a region (6) upstream of said valve and having a bell-shaped housing (16), (f) a spring biased deformable diaphragm (8) confined between said housing and said projection, said diaphragm defining, with said housing, a first chamber (10); and defining, with said projection, a second chamber (11), (g) said first chamber being in hydraulic communication with said downstream region, and said second chamber being in hydraulic communication with said region upstream of said valve, (h) a shutter member (9) connected to said diaphragm and operable to connect said upstream region to a fuel discharge via a fuel passage opening (28) disposed in said projection, (i) an elongate rectilinear first passage (29) disposed in said projection in generally coaxial relationship with said shutter member, and with said first passage extending generally parallel to said second axis, said first passage extending between said second chamber (11) and said region (6) upstream of said valve, (j) a fuel blocking closure plug (31) disposed in said first passage and separating the latter into:

(1) a first section (32) opening into said upstream region, (2) and a second section (33) opening into said second chamber (11), (k) an elongate rectilinear second passage (30) disposed in said projection and spaced from and generally parallel to and coextensive with said first passage, said second passage extending between said second chamber (11) and said upstream region (6), (l) a fuel supplying third passage (34) disposed in said projection and communicating with said first section (32) of said first passage (29), (m) and a fuel discharging fourth passage (35) disposed in said projection and communicating with said second section (33) of said first passage (29), (n) said fuel passage opening (28) being disposed in said second section (33) of said first passage (29).

2. A device according to claim 1 wherein the axes of said first, third and fourth passages (29, 34, 35) are horizontally coplanar; and the axes of said first and second passages (29, 30) are vertically coplanar.

3. A device according to claim 1 which includes duct means (36) connecting said first chamber (10) with said downstream region (4), said duct means including:

(a) first passage means (37) disposed in said pressure regulator housing (16), (b) and second passage means (38) disposed in said projection (15) and registering with said first passage means (37).

4. In a device for supplying a mixture of air and fuel to the manifold of an internal combustion engine:

(a) a support body (1), (b) an electromagnetically operated fuel atomisation and metering valve (3) housed in said body and defining a first axis; said body forming a region (4) downstream of said valve, and said valve forming means for delivering predetermined quantities of fuel to said downstream region, (c) a projection (15) integrally formed with said body and extending laterally from said valve, (d) a fuel pressure regulator (5) mounted to an end of said projection and defining a second axis generally normal to said first axis, (e) said presure regulator being responsive to pressure in a region (6) upstream of said valve and having a bell-shaped housing (16), (f) a spring biased deformable diaphragm (8) confined between said housing and said projection, said diaphragm defining, with said housing, a first chamber (10); and defining, with said projection, a second chamber (11), (g) said first chamber being in hydraulic communication with said downstream region, amd said second chamber being in hydraulic communication with said region upstream of said valve, (h) a shutter member (9) connected to said diaphragm and operable to connect said upstream region to a fuel discharge via a fuel passage opening (28) disposed in said projection, (i) and means supporting said valve (3) within said body (1) for relative angular positioning thereof, said supporting means including:

(1) a deformable support ring (42) disposed between said valve and said body, (2) and a pair of studs (43) projecting from opposite faces of said ring, (3) one of said studs being removably disposed in a cavity in said valve, (4) and the other of said studs being removably disposed in a cavity in said body.

5. In a device for supplying a mixture of air and fuel to the manifold of an internal combustion engine:

(a) a support body (1), (b) an electromagnetically operated fuel atomisation and metering valve (3) housed in said body and defining a first axis; said body forming a region (4) downstream of said valve, and said valve forming means for delivering predetermined quantities of fuel to said downstream region, (c) a projection (15) integrally formed with said body and extending laterally from said valve, (d) a fuel pressure regulator (5) mounted to an end of said projection and defining a second axis generally normal to said first axis, (e) said pressure regulator being responsive to pressure in a region (6) upstream of said valve and having a bell-shaped housing (16), (f) a spring biased deformable diaphragm (8) confined between said housing and said projection, said diaphragm defining, with said housing, a first chamber (10); and defining, with said projection, a second chamber (11), (g) said first chamber being in hydraulic communication with said downstream region, and said second chamber being in hydraulic communication with said region upstream of said valve, (h) a shutter member (9) connected to said diaphragm and operable to connect said upstream region to a fuel discharge via a fuel passage opening (28) disposed in said projection, (i) and means to secure said valve (3) within said body (1), said securing means including:

(1) an annular collar (45) mounted to said body and with said collar having an annular projection (46), (2) an annular conical surface (47) formed on said valve and with said surface being disposed adjacent said projection, (3) and a deformable ring (48) of substantially trapezoidal section interposed between said collar and said conical surface.

* * * * *